US005830003A

United States Patent [19]

Sahlberg et al.

[11] Patent Number: 5,830,003

[45] **Date of Patent: *Nov. 3, 1998**

[54] ELECTRICAL CONDUCTOR CONNECTING SYSTEM

[75] Inventors: Douglas Sahlberg, Snohomish; DeWayne Anderson, Kirkland, both of Wash.

[73] Assignee: Leviton Manufacturing Co., Inc., Little Neck, N.Y.

[ * ] Notice: The term of this patent shall not extend beyond the expiration date of Pat. No. 5,645,444.

[21] Appl. No.: 885,655

[22] Filed: Jun. 30, 1997

Related U.S. Application Data

[63] Continuation of Ser. No. 376,597, Jan. 20, 1995, Pat. No. 5,645,444.

[51] Int. Cl.[6] ..... H01R 4/24

[52] U.S. Cl. ..... 439/392

[58] Field of Search ..... 439/392, 395, 439/404, 405, 417, 676

[56] References Cited

U.S. PATENT DOCUMENTS

| | | | |
|---|---|---|---|
| 3,963,318 | 6/1976 | Tucker | 439/392 |
| 4,066,320 | 1/1978 | Goodrich et al. | 439/392 |
| 4,370,009 | 1/1983 | Dola | 439/392 |
| 4,834,668 | 5/1989 | Markwardt | 439/392 |

*Primary Examiner*—Neil Abrams
*Assistant Examiner*—Brian J. Biggi
*Attorney, Agent, or Firm*—Paul J. Sutton

[57] ABSTRACT

A multi-conductor communications jack where the individual insulated conductors are forced into associated insulation displacing contacts to make a mechanical and electrical joint with the metallic conductor therein by means of an impact tool which also has thereon a cutting edge for severing the portion of the insulated conductor that extends beyond the jack lead frame. The improvement comprising a series of anvils adjacent the frame and insulation displacing contacts to support the insulated conductor and insure a clean cut without injury to the conductor or insulation.

8 Claims, 7 Drawing Sheets

ELECTRICAL CONDUCTOR CONNECTING SYSTEM

This Application is a continuation of U.S. patent application Ser. No. 08/376,597 filed Jan. 20, 1995 now U.S. Pat. No. 5,645,444.

BACKGROUND OF THE INVENTION

1. Field of the Invention

The invention pertains to communications jacks and the wiring of such jacks and more particularly to the termination of individual conductors in associated insulation displacing contacts ("IDC") of a communications jack and the severing of the excess insulated conductor beyond the lead frame support of such jack.

2. Description of the Prior Art

At present individual insulated conductors are terminated in insulation displacing contacts and the portion of the insulated conductor beyond the lead frame support is severed by a cut-off blade on available impact tools. These tools engage the insulated conductor on either side of the IDC slot and force the insulated conductor downwardly into the slot slicing through the insulation, parting it and making electrical and mechanical contact with the metallic conductor therein.

The tool cutting edge scrubs along the outer surface of the lead frame support and if the edge is sharp and the impact high, the insulated conductor may be cleanly severed. However, if the blade cutting edge is not sharp, the impact is low, the insulation soft and pliable and the metallic conductor soft and ductile, the cut will be anything but sharp. The distortion of the insulated conductor outside of the lead frame support could also cause problems in the IDC slot. The conductor could be cut or thinned making for a poor or little contact. There can be exposed bare conductor ends which could short out other conductors and the like.

SUMMARY OF THE INVENTION

The invention disclosed herein overcomes the difficulties noted above with respect to the described prior art devices by providing a cutting edge to support the insulated conductor to be severed, adjacent the lead frame support and back-up the cutting blade so that a smooth, clean cut can be made, adjacent the lead frame support, to permit the excess insulated conductor to be removed without affecting the quality of the conductor joint at the IDC slot. It is an object of the invention to provide an improved connector which facilitates the removal of any excess portion of a conductor beyond the connector.

It is another object of the invention to provide an improved connector which provides a support for any excess conductor beyond the connector to facilitate the removal of such excess conductor.

It is yet another object of the invention to provide an improved connector which provides a support for any excess conductor beyond the connector and provides an anvil for a cutting blade employed to sever such excess conductor.

Other objects and features of the invention will be pointed out in the following description and claims and illustrated in the accompanying drawings, which disclose, by way of example, the principles of the invention, and the best mode presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
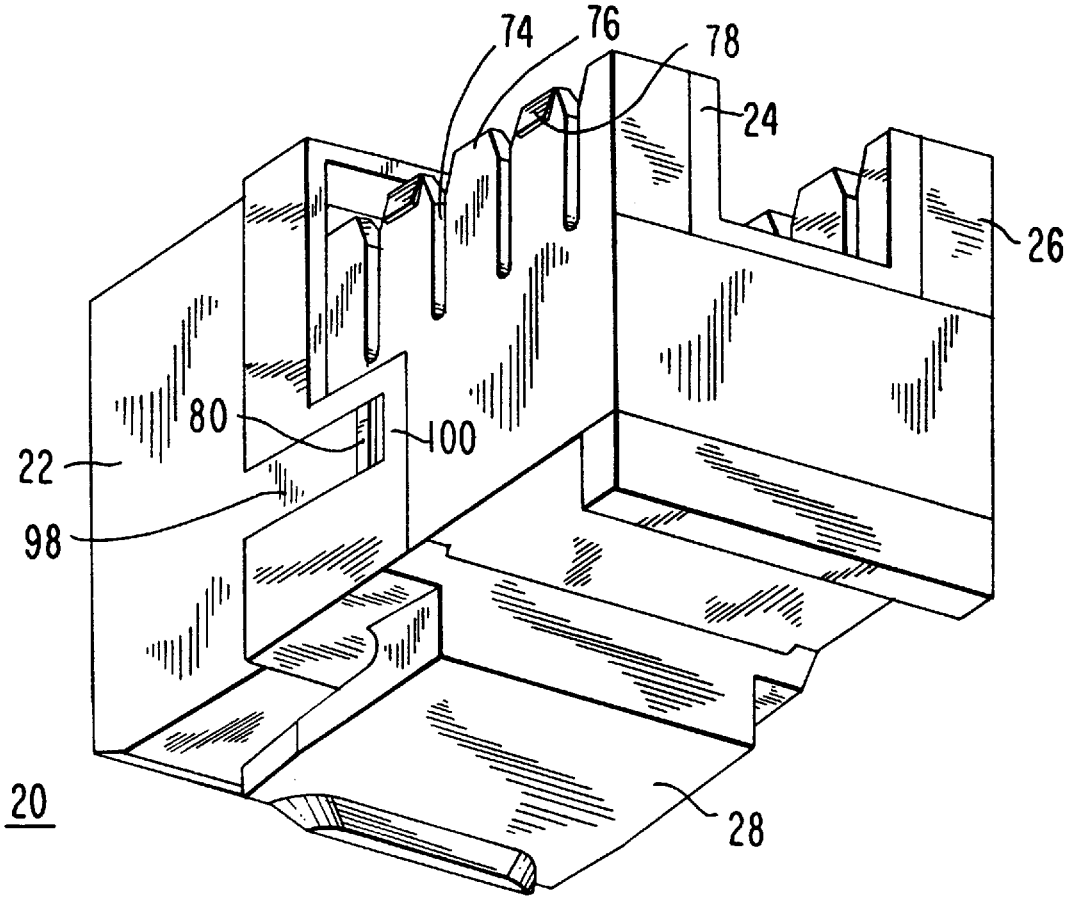
FIG.1 PRIOR ART
FIG. 1 is an isometric view taken from below and to the left of the object, of communications jack assembly according to the prior art.
Figure 2:
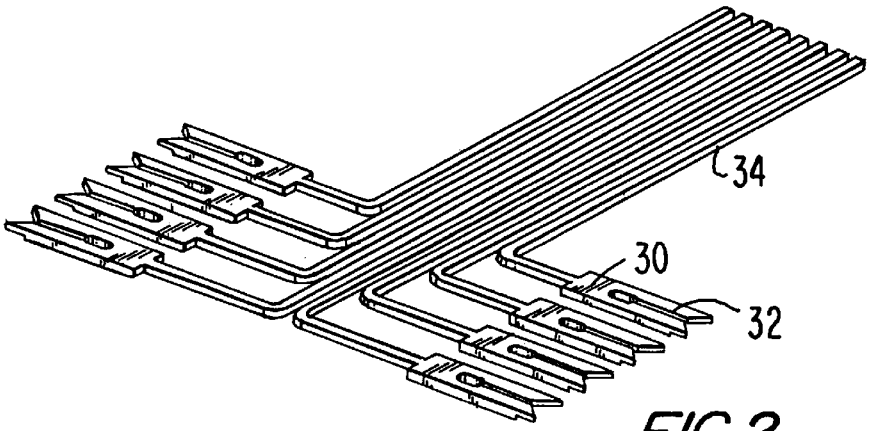
FIG.2 PRIOR ART
FIG. 2 is an isometric view of the lead frame contracts of FIG. 1.

Turning to FIGS. 1 to 10 15 and 16 there is shown a communications jack assembly 20 constructed in accordance with the prior art and an impact tool often used to install insulated conductors thereto. Jack assembly 20 comprises a body 22, a lead frame carrier 24 and a lead frame support 26, shown in FIG. 1 and other components not visible in FIG. 1. Body 22 has a deflectable latch 28 which is used to lock jack assembly 20 into a corresponding aperture in a support frame (not shown) as is well known in the art. The latch 28 deflects towards body 22 as the body 22 is in advanced into a support frame aperture from the rear and expands away from body 22 after assembly 20 is properly positioned. Assembly 20 can be removed from the rear of the support frame by deflecting the latch 28 and pulling assembly 20 free of the support frame.

The contacts 30 (see FIG. 2) are of the insulation displacement type which do not require that the insulation be removed from an insulated conductor before it can be assembled to a contact. Instead each of the contacts 30 is formed with a slot 32 whose walls are sharp. When an insulated conductor (now shown) is forced down the slot 32, the insulation is severed and displaced in the area of the slot 32 so that the contact arms defining the slot 32 make a good mechanical and electrical contact with the metallic central conductor of the insulated conductor. Each of the contacts 30 has a lead 34 formed when the contact 30 is stamped out. The contacts 30 and leads 34 may be connected to runners at one or both ends during manufacture to hold the positions of the contacts 30 until installation upon the lead frame carrier 24 at which time they are removed.

Figure 3:
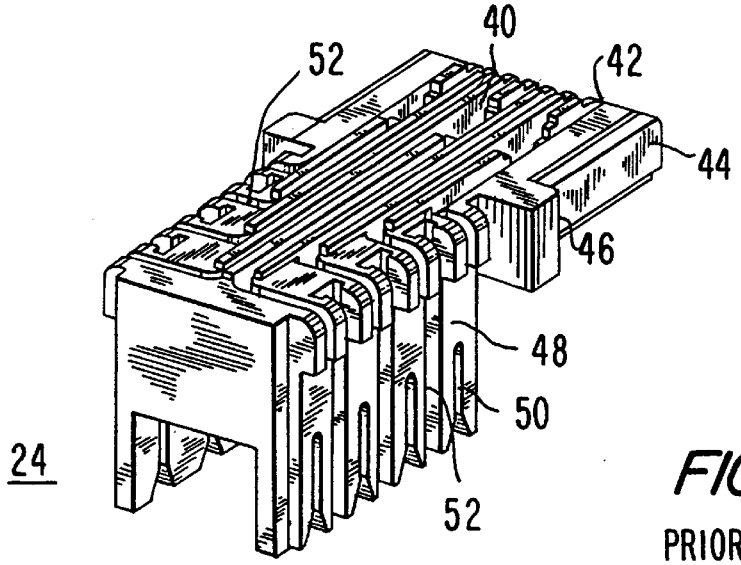
FIG.3 PRIOR ART
FIG. 3 is an isometric view of the lead frame carrier of the device of FIG. 1.
Figure 4:
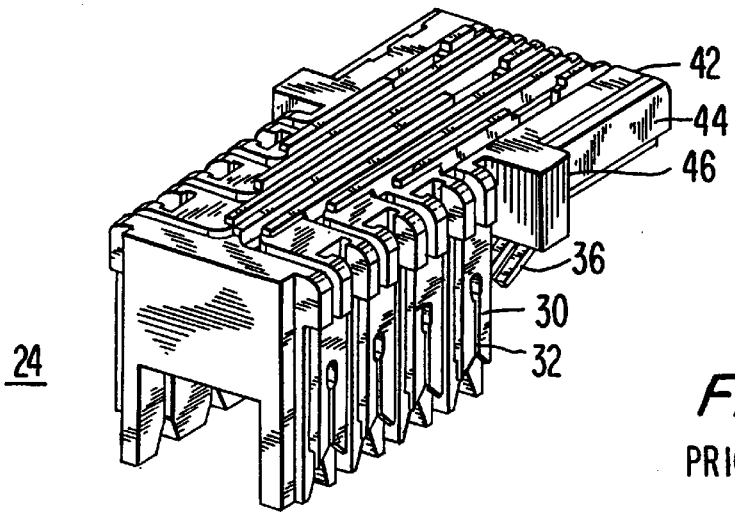
FIG.4 PRIOR ART
FIG. 4 is an isometric view of the lead frame contacts of FIG. 2 installed on the lead frame carrier of FIG. 3.

The lead frame carrier 24 is shown in FIGS. 3 and 4. A number of grooves 40 are formed along the longitudinal axis of carrier 24. Each of the grooves 40 will receive one of the leads 34 therein. At a first end 42, the frame is rounded and the free ends of the leads 34 are bent around end 42 to form the contacts 36 of the completed jack assembly 20. Rails 44 permit the lead frame carrier 24 to be assembled to the body 22 and stops 46 limit insertion of the lead carrier 24 into body 22. The contacts 30 are bent perpendicularly to leads 34 and are positioned adjacent supports 48. Each of the supports 48 has a slot 50 which is aligned with contact slot 32 so that access to the contacts is provided.

Figure 5:
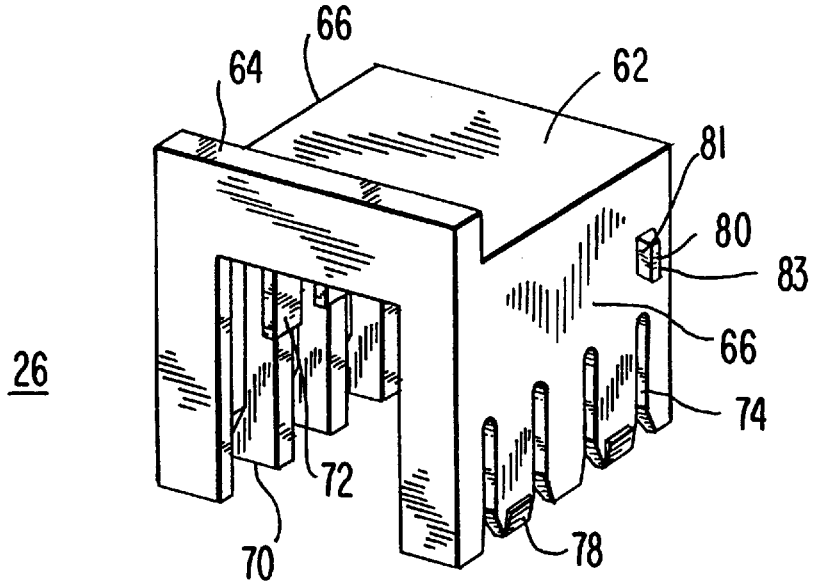
FIG.5 PRIOR ART
FIG. 5 is an isometric view of the lead frame support of the device of FIG. 1.
Figure 6:
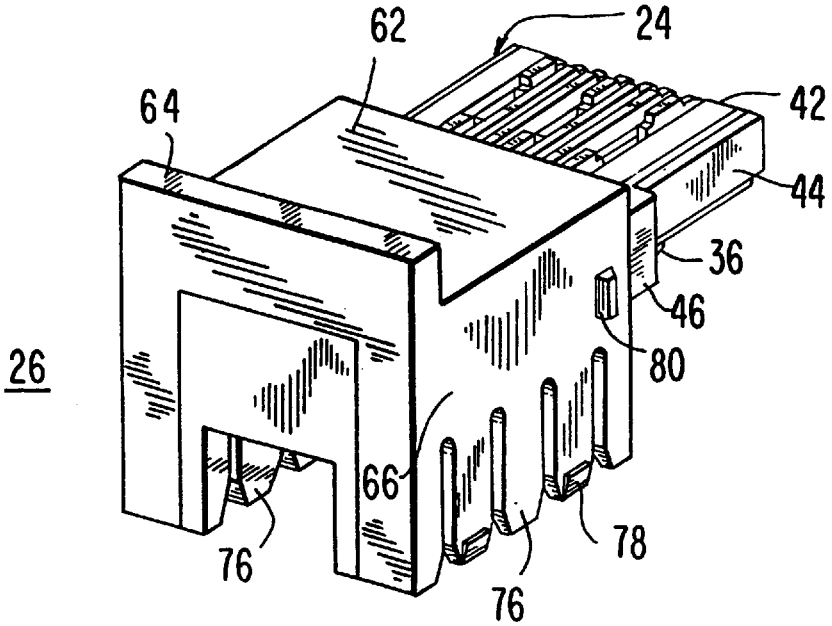
FIG.6 PRIOR ART
FIG. 6 is an isometric view of the lead frame support of FIG. 5 assembled to the lead frame contacts and lead frame carrier assembly of FIG. 4.

Turning now to FIGS. 5 and 6 the lead frame support 26 and its assembly to the lead frame carrier 24 with contacts 30 assembled thereto are described. Lead frame support 26, which is mounted over carrier 24 has a base 62 the underside of which contains a support foot 64 which may engage a support surface (not shown). Projecting upwardly from base 62 are two, parallel, spaced apart side walls 66 which have a series of slots 74 positioned along their length. A series of ribs 70, having enlargements 72 adjacent base 62 fit into the channels 52 between the supports 48 of the lead frame carrier 24. The ribs 70 guide the lead frame support 60 along channels 52, and the enlargements 72 lock the support 26 to the carrier 24 by engaging the side walls of the channels 52. The of slots 74, in both side walls, are aligned with the positions of the contact slots 32 to permit access to the contact slots 32. Thus the slots 50 in supports 48 of lead frame carrier 24, slots 32 in contacts 30 and slots 74 in walls 66 of the lead frame support 26 are all aligned and an electrical conductor can be supported therein. The insulation can be received in slots 50 and 74 and the central conductor received in the slot 32 of contact 30. At the ends of some of the fingers 76 formed by slots 74 in side walls 66 are locking tabs 78 and further locking tabs 80 appear on both side walls 66. The functions of these tabs will be described below.

Figure 7:
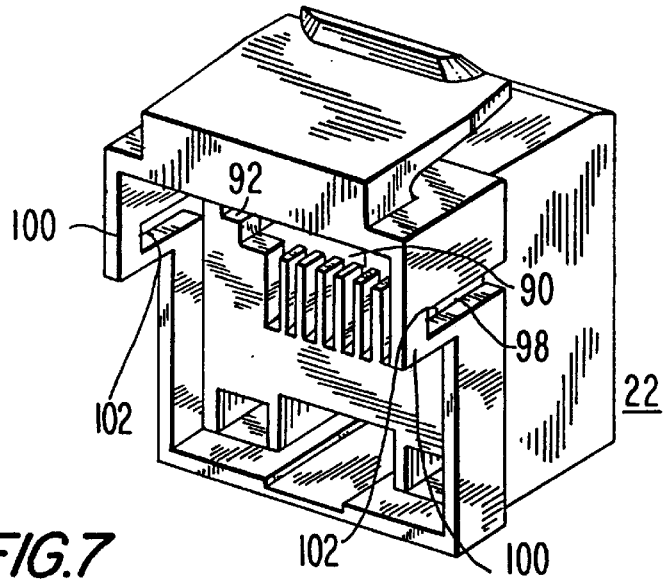
FIG.7 PRIOR ART
FIG. 7 is an isometric view of the body of the device of FIG. 1.
Figure 15:
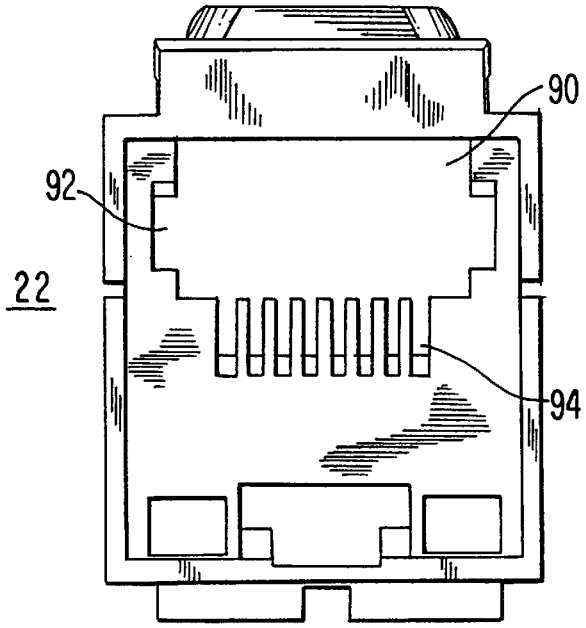
FIG. 15 PRIOR ART
FIG. 15 is a rear elevational view of the body of FIG. 7.
Figure 16:
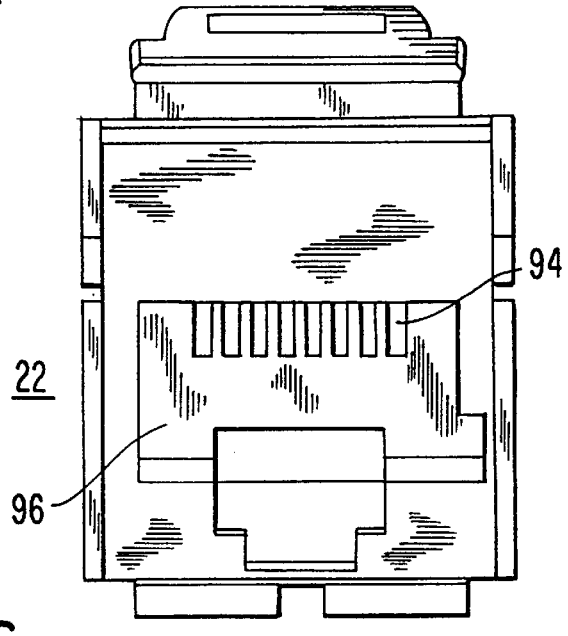
FIG. 16 PRIOR ART
FIG. 16 is a front elevational view of the body of FIG. 7.

FIGS. 7, 15 and 16 show body 22 which is assembled to the sub assembly of FIG. 6,, as shown in FIG. 1. An aperture 90 is generally rectangular to accept the lead frame carrier 24 adjacent end 42. Side slots 92 communicating with aperture 90 are shaped to receive rails 44 of carrier 24. Slots 94 receive the contacts 36 adjacent the plug aperture 96 in the front face of body 22 as shown in FIG. 16. Slots 98 on flexible arms 100 provide shoulders 102 to engage the flat back surfaces 83 of locking tabs 80. The arms 100 are deflected outwardly as inclined front face 81 of tabs 80 engage such arms 100 as the lead frame support 26 is advanced within body 22. Once the tabs 80 enter slots 98, the arms 100 return to the position as shown in FIG. 1 to retain the body 22 and lead frame support 26 in assembly.

Figure 8:
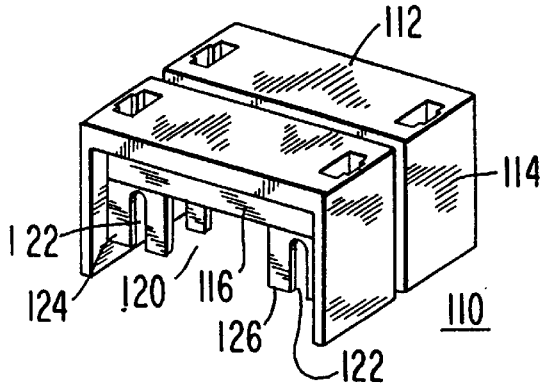
FIG.8 PRIOR ART
FIG. 8 is an isometric view of a stuffer cap for use with the device of FIG. 1.

The individual conductors of a cable to be terminated can be placed in the slots of the jack assembly 20 and terminated by means of a stuffer cap 110 shown in FIG. 8. Stuffer cap 110 has a base 112 and two depending, parallel, spaced apart, side walls 114. Along the interior surface of base 112 and walls 114 are a front wall 116 and a rear wall not visible in FIG. 8). Front wall 116 has a central rectangular recess 120 and two slots 122 so as to describe two narrow fingers 124 and 126 adjacent the side walls 114. The rear wall is similar to front wall 116.

When the stuffer cap 110 is positioned on lead frame support 26, the outer fingers 124 enter slots 74 in side walls 66 of support 26, the inner fingers 126 enter slots 50 in supports 48 of lead frame carrier 24 and the slots 122 are positioned over the ends of the contacts 30. If an insulated electrical conductor (not shown) is positioned across contact 30 and in slots 74 and 50 and stuffer cap 110 is pushed downwardly towards the base 62 of lead frame support 26, then the conductor insulation will be severed and displaced and contact will be established between contact 30 and the central metallic conductor.

However, in order for the stuffer caps 110 to operate properly, any excess insulated conductor beyond side wall 66 of support 26 must be removed first. The presence of the excess conductor will bow side walls 114 of stuffer caps 110 and prevent its proper seating.

Since there are four fingers 124 and four fingers 126, four conductors could be terminated at the same time. But because of the sizes of the parts involved and the need to control four separate conductors the termination of all four conductors at the same time is quite difficult.

Although not shown a small cross member is placed between front wall 116 and a rear wall on the interior surface of each of the side walls 114 to act as a catch for the locking tabs 78 of fingers 76 of lead frame 26. This locking action insures that the insulated conductor is fully inserted into slots 32 of contacts 30. If insulated conductors are installed using stuffer cap 110, one at a time, the cap 110 must be released to gain access to the other contacts 30 under stuffer cap 110. This is done by expanding side walls 114 away from the lead frame support 26 and pulling stuffer cap 110 upwardly away from lead frame support 26. The stuffer cap 110 can also be applied to lead frame support 26 after all of the conductors are properly seated in slots 32 of contacts 30. This provides strain relief to the conductor on both sides of contact 30, prevents unintentional access and acts as an environmental seal against dirt and other contaminants.

Figure 9:
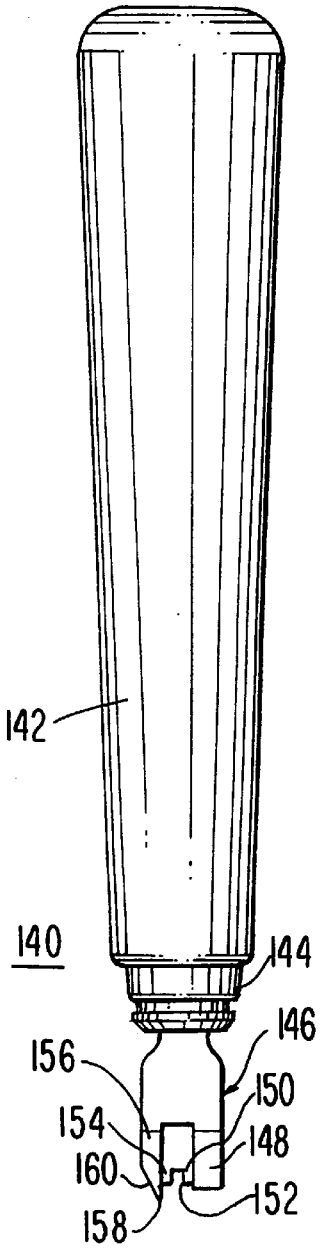
FIG.9 PRIOR ART
FIG. 9 is a side elevational view of an impact tool to install electrical conductors to the contacts of the device of FIG. 1.
Figure 12:
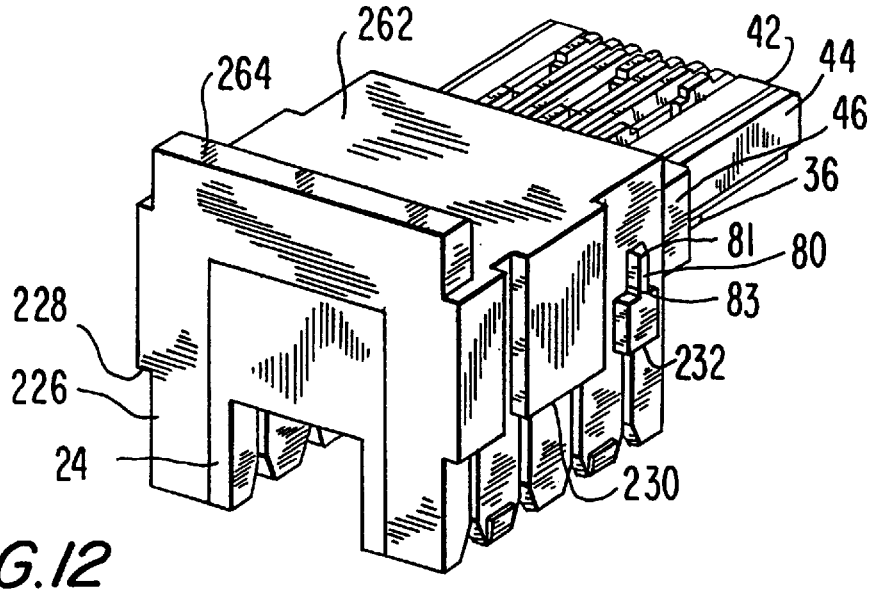
FIG. 12 is an isometric view of the lead frame support of FIG. 11 assembled to the lead frame contacts and lead frame carrier assembly of FIG. 4.
Figure 13:
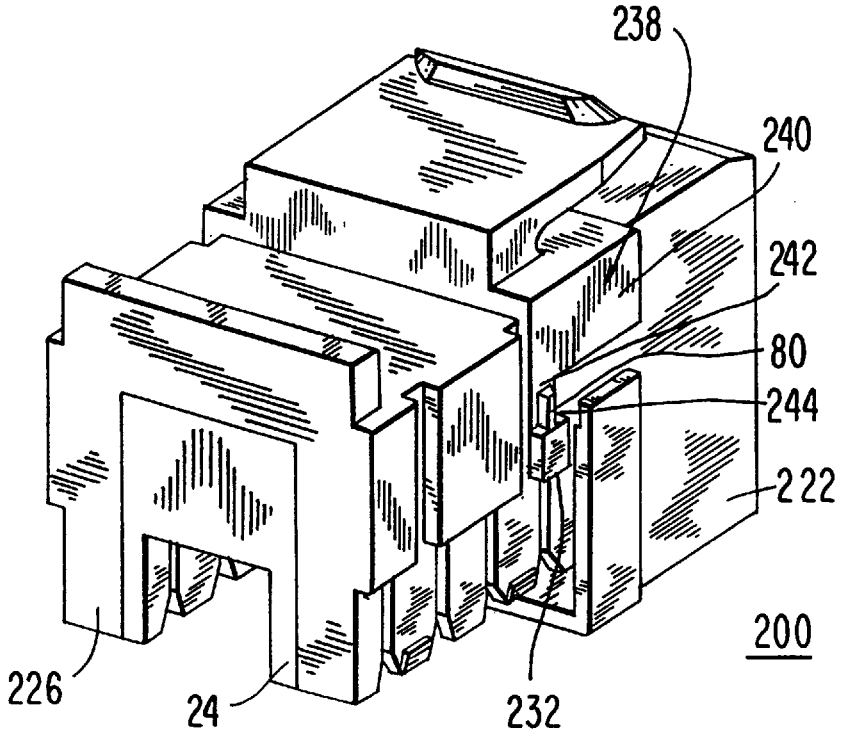
FIG. 13 is an isometric view of the assembly of the components of FIG. 12 with a modified body of the type shown in FIG. 7.

Because the insulated conductors have small external diameters, and the space to work in is small and because it is difficult to align the conductors with the slots 32, 50 and 74 especially when the conductor can not extend beyond the side wall 66 of support 26, while aligning the stuffer cap 110 with these same slots resort is had to various hand tools to install the insulated conductors in the slots 32 of contacts 30 and cut-off the excess insulated conductor beyond the side wall 66 of support 26. One such tool is shown in FIG. 9. The tool 140 is an impact tool having a compression spring (not shown) in its handle 142. The spring is connected to a plunger 144 which is forced into handle 142 by the punch-down bit or punch-down implement, to be described, until a settable predetermined value is reached. The implement is forced against the work piece with a force corresponding to the predetermined value.

The implement 146 has a first pushing portion 148 which engages the conductors between the supports 48, a second pushing portion 150 which engages the portion of the conductor in slot 50 in support 48 of lead frame carrier 24 and a recess 152 which can accommodate the upper portion of the contact 30 to permit the pushing portions maxim conductor contact. A further pushing portion 154 engages the conductor in slot 74 in side wall 66 of lead frame support 26. The final portion of implement 146 is cut-off blade 156 which extends from a cutting edge 158 below the level of the remaining portions of implement 146 and along an inclined face 160.

Figure 10:
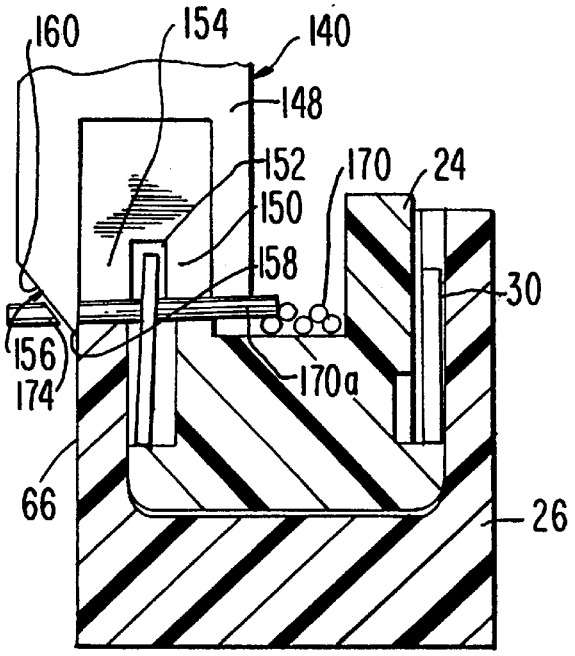
FIG.10 PRIOR ART
FIG. 10 is a fragmentary front elevational view, partly in section, of the device of FIG. 1 with a conductor being installed to a contact with the tool of FIG. 9.

The operation of tool 140 to install a conductor 170 to jack assembly 20 is shown in FIG. 10. Eight insulated conductors 170 are positioned between supports 48 of carrier 24 and fanned out, one adjacent each of the eight contacts as shown by insulated conductor 170*a*. The conductor 170*a* is manually pushed part way into slot 32 of contact 30 with a tail 174 extending beyond wall 66. The tool 140 is aligned with the contact 30 such that pushing portion 150 enters slot 50, pushing portion 154 enters slot 74, the upper portion of contact 30 enters recess 152 and the cutting edge 158 of blade 156 engages conductor 170*a*. As the implement 146 moves downwardly in FIG. 10, pushing portion 148 engages insulated conductor 170*a* to provide strain relief for the conductor 170*a* as installation is completed so as to minimize any stretching of the conductor or its insulation as the insulated conductor 170*a* is forced into slot 32 of contact 30. The cut-off blade 156 severs tail 174 from insulated conductor 170*a* and the tail 174 falls free of the jack assembly 20. After all of the insulated conductors 170 are installed stuffer cap 110 is added and the installation is complete. The concept is that if a sharp cutting blade is operated at a high rate of speed, the insulated conductor tail 174 can be cleanly severed from the remainder of the insulated conductor 170*a* which will be stiff enough to allow cut-off without any further support for the insulated conductor 170*a*.

The foregoing sequence may well apply to situations where the blade 156 cutting edge 158 is sharp, the blade 156 is precisely positioned with respect to wall 66 and a high impact force employed. However, if cutting edge 158 is not sharp, or if blade 156 is not closely positioned to wall 66, if the conductor insulation has a high modulus of elasticity or the metallic conductor is very ductile the blade 156 may not sever the tail 174 from the remainder of insulated conductor 170*a*. The insulated conductor 170*a* could be bent along wall 66 in which state it would prevent installation of the stuffer cap 110. The insulation of the conductor could be removed leaving a bare metallic conductor which could cause shorts to other in conductors, or the insulated conductor 170*a* could be broken at slot 32 of contact 30 making a poor contact with conductor 170*a* or no contact at all.

Figure 11:
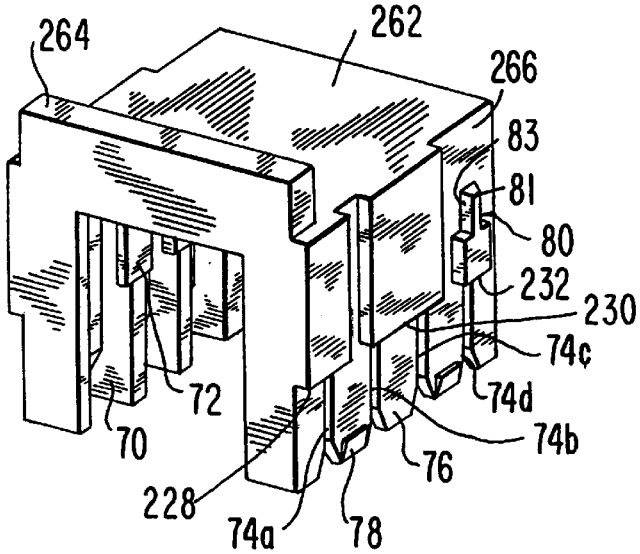
FIG. 11 is an isometric view of a lead frame support constructed in accordance with the concepts of the invention which can be used with the remaining components of the device of FIG. 1.

Turning now to FIGS. 11 to 14 there is shown a snap-in jack assembly 200 constructed in accordance with the invention. FIG. 11 shows a lead frame support 226 employed with assembly 200. The outer walls 266 have been modified to add a series of anvils or ledges. Anvil or ledge 228 is adjacent the base of slot 74*a*, anvil or ledge 230 is adjacent the bases of slots 74*b* and 74*c* while anvil or ledges 232 is adjacent the base of slot 74*d*. The opposite side wall 266, not visible in FIG. 11 has a similar arrangement to that described so that there is an anvil or ledges at the base of each of the eight contacts of jack assembly 200.

The latch between the lead frame support 226 and the body 222 is altered because the flexible arms can not extend about the entire locking latch 80 as is done with flexible arms 100 of jack assembly 20 of FIG. 1. Instead, locking arm 238 is made up of a first portion 240 which extends along the longitudinal axis and a second portion 242 perpendicular thereto. Inner surface 244 of second portion 242 engages the rear surface 83 of locking tab 80 to hold in assembly the components of jack assembly 200. The leading edge 81 of locking tab 80 forces locking arm 238 away from the body 222, but once the rear surface 83 is adjacent inner surface 244, the locking arm 238 returns to its initial position with inner surface 244 now engaging rear surface 83.

Figure 14:
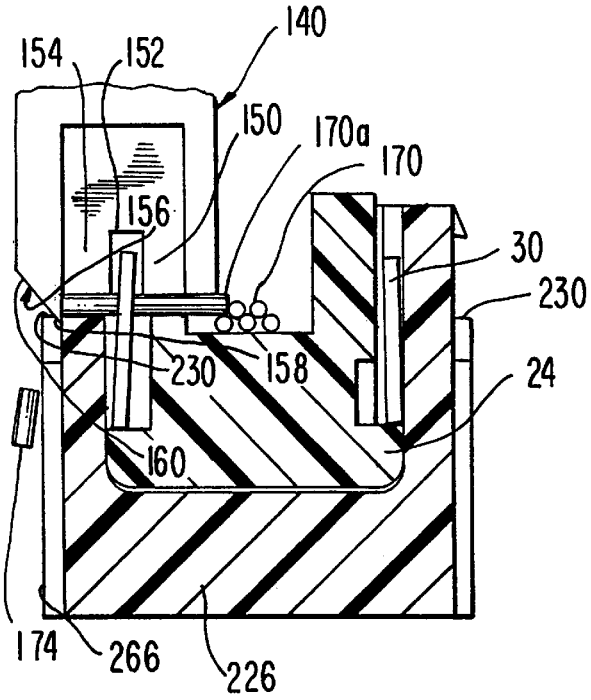
FIG. 14 is a fragmentary front elevational view, partly in section, of the device of FIG. 13 with a conductor being installed to a contact with the tool of FIG. 9.

Turning now to FIG. 14 the manner of installing insulated conductors 170 to the improved jack assembly 200 is shown. The lead frame carrier 24, the contacts 30 and the tool 140 remain the same. The significant change made is the addition of the anvils or ledges 228, 230 and 232 to the lead frame support 226. In FIG. 14, it is assumed that insulated conductor 170*a* has been routed between the supports 48 and into a slot 50 in a support 48 of lead frame carrier 24. The insulated conductor 170*a* is then guided into slot 32 of contact 30 and through slot 74*c* of lead frame support 226, over anvil or ledge 230 and extending beyond side wall 266 of support 226. As above described, the insulated conductor 170*a* is first manually pushed into slot 32 of contact 30. The tool 140 is pushed downwardly in FIG. 14 so that pushing portion 150 enters slot 50, pushing portion 154 enters slot 74, the upper portion of contact 30 enters slot 150 and the cutting edge 158 of blade 156 engages conductor 170*a*. Because of the presence of anvil or ledge 230 to support and back-up the insulated conductor 170*a*, a clean cut can be achieved and tail 174 is severed as the blade 156 advances to anvil or ledge 230 through insulated conductor 170*a*.

While there have been shown and described and pointed out the fundamental novel features of the invention as applied to the preferred embodiment, it will be understood that various omissions and substitutions and changes of the form and details of the device illustrated and in its operation may be made by those skilled in the art, without departing from the spirit of the invention.

The embodiments of the invention in which an exclusive property or privilege is claimed are defined as follows:

1. An electrical connector, such as a voice/or data telecommunications jack, or the like, comprising, in combination:

a) a lead frame carrier capable of carrying electrical contacts and conductors;

b) a first electrical conductor carried by said lead frame carrier;

c) an insulated second conductor formed with a central conductor surrounded by electrical insulation material;

d) one contact supported on said lead frame carrier, said one contact in electrical communication with said electrical conductor and being formed of electrically conducting material, said contact being capable of conducting electricity between said first conductor and said insulated second conductor after connection of said insulated second conductor to said contact;

e) said contact having an upper portion formed with a surface capable of initially supporting and aligning a relatively permanent length of said insulated second conductor and a lower portion to support said relatively permanent length of insulated second conductor when fully installed in said contact; said contact having a slot therein extending from said upper portion towards said lower portion, said slot having at least one defining wall sharpened to sever the insulation and make mechanical and electrical contact with said central conductor of the insulated second conductor and establish a connection to said first electrical contact;

f) a lead frame support having an interior to receive said lead frame carrier and an exterior surface;

g) said lead frame support being formed, on said exterior surface with an external integral outwardly extending anvil projection including an anvil support/severing surface; and h) said anvil projection support/severing surface comprising means for (i) supporting a relatively temporary length of said insulated second conductor in substantially coaxial alignment with respect to said relatively permanent length thereof at a connection time when said lower contact portion is in electrical communication with said central conductor, (ii) supporting a predetermined portion of the relatively permanent length during said connection, and (iii) thereafter receiving severing forces transmitted by a tool through said insulated second conductor at a location intermediate said permanent and temporary length thereof and proximate said contact, thereby facilitating final severing of said temporary length from said permanent length by means of said tool.

2. An electrical connector, such as a voice/or data telecommunications jack, or the like, comprising, in combination:

a) a lead frame carrier for carrying a plurality of electrical contacts and a plurality of conductors, one conductor for each of said electrical contacts;

b) a plurality of electrical conductors, one for each of said plurality of electrical contacts, carried by said lead frame carrier;

c) a plurality of insulated second conductors, one for each of said contacts, each of said insulated second conductors formed with a central conductor surrounded by electrical insulation material;

d) a plurality of electrical contacts supported on said lead frame carrier, each of said contacts in electrical communication with an associated one of said electrical conductors and being formed of electrically conducting material, each of said contacts being capable of conducting electricity between one of said electrical conductors and an associated second conductor after connection of said insulated second conductor to said associated contact;

e) each of said contacts having an upper portion formed with a surface capable of initially supporting and aligning a relatively permanent length of an associated insulated second conductor and a lower portion to support said associated relatively permanent length of insulated second conductor when fully installed in said associated contact; said contacts each having a slot therein extending from said upper portion towards said lower portion, said slot having at least one defining wall sharpened to sever the insulation and make mechanical and electrical contact with said central conductor of an associated insulated second conductor and establish a connection to an associated one of said first electrical conductors;

f) a lead frame support having an interior to receive said lead frame carrier and an exterior surface;

g) said lead frame support being formed, on said exterior surface, with an external integral outwardly extending anvil projection including an anvil support/severing surface being adjacent each of said contacts; and h) said anvil projection support/severing surface comprising means for (i) each supporting a relatively temporary length of said insulated second conductor in substantially coaxial alignment with respect to said associated relatively permanent length thereof at a connection time when said lower contact portions are in electrical communication with said associated central conductors, (ii) each supporting a predetermined portion of said associated relatively permanent length during said connection, and (iii) thereafter receiving severing forces transmitted by a tool through each of said insulated second conductors at a location intermediate said permanent and temporary lengths thereof and proximate each associated contact, thereby facilitating final severing of each of said temporary lengths from the associated permanent lengths by means of said tool.

3. An electrical connector, as defined in claim 2, wherein said anvil projection support/severing surface is two projections, one extending along each of two parallel exterior surfaces of said lead frame support.

4. An electrical connector, as defined in claim 2, wherein said anvil projection support/severing surface is a plurality of projections extending from two parallel exterior surfaces of said lead frame support.

5. An electrical connector, as defined in claim 4, wherein some of said anvil projection support/severing surfaces are adjacent single ones of said contacts and others are adjacent two of said contacts.

6. In a jack assembly, an insulated conductor terminating portion comprising:

a) an insulation displacing contact;

b) a first electrical conductor coupled to said insulation displacing contact;

c) an insulated second electrical conductor having a central conductor surrounded by electrical insulation material;

d) said insulation displacing contact having a upper portion and a lower portion and a slot extending from said upper portion towards said lower portion, said slot defined by at least one sharp edge to cut through the electrical insulation material of a relatively permanent length of said insulated second electrical conductor as same is moved along said slot by a tool and make a good mechanical and electrical joint between said first electrical conductor and said insulated second conductor;

e) body means for receiving and supporting said insulation displacing contact, said body means having an outer surface formed with an external integral outwardly extending anvil projection including an anvil support/severing surface;

f) said anvil projection support/severing surface comprising means for (i) supporting a relatively temporary length of said insulated second conductor in substantially coaxial alignment with respect to said relatively permanent length thereof at a connection time when said lower contact portion is in electrical communication with said central conductor of said insulated second conductor, (ii) supporting a predetermined portion of the relatively permanent length during said connection, and (iii) thereafter receiving severing forces transmitted by a tool through said insulated second conductor at a location intermediate said permanent and temporary lengths thereof and proximate said insulation displacing contact, thereby facilitating a final severing of said temporary length from said permanent length by means of said tool.

7. In a jack assembly, as defined in claim 6, wherein said anvil projection support/severing surface is two projections, one extending along each of two parallel exterior surfaces of said body means.

8. In a jack assembly, as defined in claim 6, wherein said anvil projection support/severing surface is a plurality of projections extending from two parallel exterior surfaces of said body means.

* * * * *